US007703526B2

(12) United States Patent
Fields et al.

(10) Patent No.: US 7,703,526 B2
(45) Date of Patent: Apr. 27, 2010

(54) APPARATUS AND METHOD FOR CHARACTERIZING A RESERVOIR

(75) Inventors: Troy Fields, Balikpapan (ID); Oivind Brockmeier, Houston, TX (US); Edward Harrigan, Richmond, TX (US); Bunker Hill, Sugar Land, TX (US); Charles Fensky, Alberta (CA); Ali Eghbali, Balikpapan (ID); Christopher Del Campo, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/028,173

(22) Filed: Feb. 8, 2008

(65) Prior Publication Data

US 2008/0135299 A1 Jun. 12, 2008

Related U.S. Application Data

(62) Division of application No. 10/881,269, filed on Jun. 30, 2004, now Pat. No. 7,380,599.

(51) Int. Cl.
*E21B 29/10* (2006.01)
*E21B 43/11* (2006.01)

(52) U.S. Cl. ..... 166/298; 166/55; 175/77

(58) Field of Classification Search ..... 166/297, 166/298, 55; 175/62, 77, 58
See application file for complete search history.

(56) References Cited

U.S. PATENT DOCUMENTS 2,516,421 A 7/1950 Robertson
2,594,292 A 4/1952 Dean
2,725,283 A 11/1955 Mounce et al.
3,530,933 A 9/1970 Whitten
3,864,970 A 2/1975 Bell
4,007,797 A 2/1977 Jeter
4,167,111 A 9/1979 Spuck, III et al.

(Continued)

FOREIGN PATENT DOCUMENTS

EP 0791723 8/1997

(Continued)

OTHER PUBLICATIONS

Crombie et al., Innovations in Wireline Fluid Sampling, Oilfield Review, pp. 26-55 (Autumn 1998).

(Continued)

*Primary Examiner*—Kenneth Thompson
(74) *Attorney, Agent, or Firm*—Dave R. Hofman

(57) ABSTRACT

An apparatus and method for characterizing a subsurface formation is provided. The apparatus includes a tool body, a probe assembly carried by the tool body for sealing off a region of the borehole wall, an actuator for moving the probe assembly between a retracted position for conveyance of the tool body and a deployed position for sealing off a region of the borehole wall and a perforator extending through the probe assembly for penetrating a portion of the sealed-off region of the borehole wall. The tool may be provided with first and second drilling shafts with bits for penetrating various surfaces. The method involves sealing off a region of a wall of an open borehole penetrating the formation, creating a perforation through a portion of the sealed-off region of the borehole wall and testing the formation.

15 Claims, 12 Drawing Sheets

U.S. PATENT DOCUMENTS

| | | | | |
|---|---|---|---|---|
| 4,185,705 | A | 1/1980 | Bullard | |
| 4,368,786 | A * | 1/1983 | Cousins | 175/78 |
| 4,860,581 | A | 8/1989 | Zimmerman et al. | |
| 4,936,139 | A | 6/1990 | Zimmerman et al. | |
| 4,994,671 | A | 2/1991 | Safinya et al. | |
| 5,056,595 | A | 10/1991 | Desbrandes | |
| 5,166,747 | A | 11/1992 | Schroeder et al. | |
| 5,195,588 | A | 3/1993 | Dave | |
| 5,233,866 | A | 8/1993 | Desbrandes | |
| 5,279,153 | A | 1/1994 | Dussan V. et al. | |
| 5,553,680 | A * | 9/1996 | Hathaway | 175/78 |
| 5,555,945 | A | 9/1996 | Schultz et al. | |
| 5,617,927 | A | 4/1997 | Maissa | |
| 5,687,806 | A | 11/1997 | Sallwasser et al. | |
| 5,692,565 | A | 12/1997 | MacDougall et al. | |
| 5,746,279 | A | 5/1998 | Havlinek et al. | |
| 5,779,085 | A | 7/1998 | Havlinek et al. | |
| 5,875,840 | A | 3/1999 | Dietle | |
| 5,939,717 | A | 8/1999 | Mullins | |
| 5,956,132 | A | 9/1999 | Donzier | |
| 6,119,782 | A | 9/2000 | Flores et al. | |
| 6,167,968 | B1 | 1/2001 | Allarie et al. | |
| 6,230,557 | B1 | 5/2001 | Ciglenec et al. | |
| 6,260,623 | B1 | 7/2001 | Schick | |
| 6,301,959 | B1 | 10/2001 | Hrametz et al. | |
| 6,378,629 | B1 * | 4/2002 | Baird | 175/75 |
| 6,659,177 | B2 | 12/2003 | Bolze et al. | |
| 6,832,515 | B2 | 12/2004 | Follini et al. | |
| 6,964,301 | B2 | 11/2005 | Hill et al. | |
| 2004/0007391 | A1 * | 1/2004 | Baird | 175/77 |

FOREIGN PATENT DOCUMENTS

| | | |
|---|---|---|
| EP | 0791721 | 7/2002 |
| SU | 968365 | 4/1981 |
| SU | 1452965 | 1/1989 |

OTHER PUBLICATIONS

Burgess et al., Formation Testing and Sampling Through Casing, Oilfield Review, pp. 46-57 (Spring 2002).
Schlumberger, CHDT Cased Hole Dynamics Tester, Jun. 2003.
Ireland et al., The MDT Tool: A Wireline Testing Breakthrough, Oilfield Review, pp. 58-65, Apr. 1992.
Schlumberger, MDT Modular Formation Dynamics Tester, Jun. 2002.
Schlumberger, Cased Hole Dynamics Tester, 2004.

* cited by examiner

APPARATUS AND METHOD FOR CHARACTERIZING A RESERVOIR

CROSS REFERENCE TO RELATED APPLICATIONS

This application is a divisional of U.S. patent application Ser. No. 10/881,269 filed Jun. 30, 2004.

BACKGROUND OF THE INVENTION

1. Field of the Invention

This invention relates generally to the downhole investigation of subterranean formations. More particularly, this invention relates to characterization of a subsurface formation by sampling through perforations in a borehole penetrating the formation.

2. Background Art

Historically, boreholes (also known as wellbores, or simply wells) have been drilled to seek out subsurface formations (also known as downhole reservoirs) containing highly desirable fluids, such as oil, gas or water. A borehole is drilled with a drilling rig that may be located on land or over bodies of water, and the borehole itself extends downhole into the subsurface formations. The borehole may remain 'open' after drilling (i.e., not lined with casing), or it may be provided with a casing (otherwise known as a liner) to form a 'cased' borehole. A cased borehole is created by inserting a plurality of interconnected tubular steel casing sections (i.e., joints) into an open borehole and pumping cement downhole through the center of the casing. The cement flows out the bottom of the casing and returns towards the surface through a portion of the borehole between the casing and the borehole wall, known as the 'annulus.' The cement is thus employed on the outside of the casing to hold the casing in place and to provide a degree of structural integrity and a seal between the formation and the casing.

Various techniques for performing formation evaluation (i.e., interrogating and analyzing the surrounding formation regions for the presence of oil and gas) in open, uncased boreholes have been described, for example, in U.S. Pat. Nos. 4,860,581 and 4,936,139, assigned to the assignee of the present invention. FIGS. 1A and 1B illustrate a known formation testing apparatus according to the teachings of these patents. The apparatus A of FIGS. 1A and 1B is of modular construction, although a unitary tool is also useful. The apparatus A is a downhole tool that can be lowered into the well bore (not shown) by a wire line (not shown) for the purpose of conducting formation evaluation tests. The wire line connections to tool A as well as power supply and communications-related electronics are not illustrated for the purpose of clarity. The power and communication lines that extend throughout the length of the tool are generally shown at 8. These power supply and communication components are known to those skilled in the art and have been in commercial use in the past. This type of control equipment would normally be installed at the uppermost end of the tool adjacent the wire line connection to the tool with electrical lines running through the tool to the various components.

As shown in the embodiment of FIG. 1A, the apparatus A has a hydraulic power module C, a packer module P, and a probe module E. Probe module E is shown with one probe assembly 10 which may be used for permeability tests or fluid sampling. When using the tool to determine anisotropic permeability and the vertical reservoir structure according to known techniques, a multiprobe module F can be added to probe module E, as shown in FIG. 1A. Multiprobe module F has sink probe assembly 14, and horizontal probe assembly 12. Alternately, a dual packer module P is commonly combined with the probe module E for vertical permeability tests.

The hydraulic power module C includes pump 16, reservoir 18, and motor 20 to control the operation of the pump 16. Low oil switch 22 provides a warning to the tool operator that the oil level is low, and, as such, is used in regulating the operation of the pump 16.

The hydraulic fluid line 24 is connected to the discharge of the pump 16 and runs through hydraulic power module C and into adjacent modules for use as a hydraulic power source. In the embodiment shown in FIG. 1A, the hydraulic fluid line 24 extends through the hydraulic power module C into the probe modules E and/or F depending upon which configuration is used. The hydraulic loop is closed by virtue of the hydraulic fluid return line 26, which in FIG. 1A extends from the probe module E back to the hydraulic power module C where it terminates at the reservoir 18.

The pump-out module M, seen in FIG. 1B, can be used to dispose of unwanted samples by virtue of pumping fluid from the flow line 54 into the borehole, or may be used to pump fluids from the borehole into the flow line 54 to inflate the straddle packers 28 and 30. Furthermore, pump-out module M may be used to draw formation fluid from the wellbore via the probe module E or F, or packer module P, and then pump the formation fluid into the sample chamber module S against a buffer fluid therein. This process will be described further below.

The bi-directional piston pump 92, energized by hydraulic fluid from the pump 91, can be aligned to draw from the flow line 54 and dispose of the unwanted sample though flow line 95, or it may be aligned to pump fluid from the borehole (via flow line 95) to flow line 54. The pump-out module can also be configured where flow line 95 connects to the flow line 54 such that fluid may be drawn from the downstream portion of flow line 54 and pumped upstream or vice versa. The pump-out module M has the necessary control devices to regulate the piston pump 92 and align the fluid line 54 with fluid line 95 to accomplish the pump-out procedure. It should be noted here that piston pump 92 can be used to pump samples into the sample chamber module(s) S, including overpressuring such samples as desired, as well as to pump samples out of sample chamber module(s) S using the pump-out module M. The pump-out module M may also be used to accomplish constant pressure or constant rate injection if necessary. With sufficient power, the pump-out module M may be used to inject fluid at high enough rates so as to enable creation of microfractures for stress measurement of the formation.

Alternatively, the straddle packers 28 and 30 shown in FIG. 1A can be inflated and deflated with borehole fluid using the piston pump 92. As can be readily seen, selective actuation of the pump-out module M to activate the piston pump 92, combined with selective operation of the control valve 96 and inflation and deflation of the valves I, can result in selective inflation or deflation of the packers 28 and 30. Packers 28 and 30 are mounted to outer periphery 32 of the apparatus A, and may be constructed of a resilient material compatible with wellbore fluids and temperatures. The packers 28 and 30 have a cavity therein. When the piston pump 92 is operational and the inflation valves I are properly set, fluid from the flow line 54 passes through the inflation/deflation valves I, and through the flow line 38 to the packers 28 and 30.

As also shown in FIG. 1A, the probe module E has a probe assembly 10 that is selectively movable with respect to the apparatus A. Movement of the probe assembly 10 is initiated by operation of a probe actuator 40, which aligns the hydraulic flow lines 24 and 26 with the flow lines 42 and 44. The probe 46 is mounted to a frame 48, which is movable with respect to apparatus A, and the probe 46 is movable with respect to the frame 48. These relative movements are initiated by a controller 40 by directing fluid from the flow lines 24 and 26 selectively into the flow lines 42, 44, with the result being that the frame 48 is initially outwardly displaced into contact with the borehole wall (not shown). The extension of the frame 48 brings the probe 46 adjacent the borehole wall and compresses an elastomeric ring (called a packer) against the borehole wall, thus creating a seal between the borehole and the probe 46. Since one objective is to obtain an accurate reading of pressure in the formation, which pressure is reflected at the probe 46, it is desirable to further insert the probe 46 through the built up mudcake and into contact with the formation. Thus, alignment of the hydraulic flow line 24 with the flow line 44 results in relative displacement of the probe 46 into the formation by relative motion of the probe 46 with respect to the frame 48. The operation of the probes 12 and 14 is similar to that of probe 10, and will not be described separately.

Having inflated the packers 28 and 30 and/or set the probe 10 and/or the probes 12 and 14, the fluid withdrawal testing of the formation can begin. The sample flow line 54 extends from the probe 46 in the probe module E down to the outer periphery 32 at a point between the packers 28 and 30 through the adjacent modules and into the sample modules S. The vertical probe 10 and the sink probe 14 thus allow entry of formation fluids into the sample flow line 54 via one or more of a resistivity measurement cell 56, a pressure measurement device 58, and a pretest mechanism 59, according to the desired configuration. Also, the flow line 64 allows entry of formation fluids into the sample flow line 54. When using the module E, or multiple modules E and F, the isolation valve 62 is mounted downstream of the resistivity sensor 56. In the closed position, the isolation valve 62 limits the internal flow line volume, improving the accuracy of dynamic measurements made by the pressure gauge 58. After initial pressure tests are made, the isolation valve 62 can be opened to allow flow into the other modules via the flow line 54.

When taking initial samples, there is a high prospect that the formation fluid initially obtained is contaminated with mud cake and filtrate. It is desirable to purge such contaminants from the sample flow stream prior to collecting sample (s). Accordingly, the pump-out module M is used to initially purge from the apparatus A specimens of formation fluid taken through the inlet 64 of the straddle packers 28, 30, or vertical probe 10, or sink probe 14 into the flow line 54.

The fluid analysis module D includes an optical fluid analyzer 99, which is particularly suited for the purpose of indicating where the fluid in flow line 54 is acceptable for collecting a high quality sample. The optical fluid analyzer 99 is equipped to discriminate between various oils, gas, and water. U.S. Pat. Nos. 4,994,671; 5,166,747; 5,939,717; and 5,956,132, as well as other known patents, all assigned to Schlumberger, describe the analyzer 99 in detail, and such description will not be repeated herein.

While flushing out the contaminants from apparatus A, formation fluid can continue to flow through the sample flow line 54 which extends through adjacent modules such as the fluid analysis module D, pump-out module M, flow control module N, and any number of sample chamber modules S that may be attached as shown in FIG. 1B. Those skilled in the art will appreciate that by having a sample flow line 54 running the length of the various modules, multiple sample chamber modules S can be stacked without necessarily increasing the overall diameter of the tool. Alternatively, as explained below, a single sample module S may be equipped with a plurality of small diameter sample chambers, for example by locating such chambers side by side and equidistant from the axis of the sample module. The tool can therefore take more samples before having to be pulled to the surface and can be used in smaller bores.

Referring again to FIGS. 1A and 1B, flow control module N includes a flow sensor 66, a flow controller 68, piston 71, reservoirs 72, 73 and 74, and a selectively adjustable restriction device such as a valve 70. A predetermined sample size can be obtained at a specific flow rate by use of the equipment described above.

The sample chamber module S can then be employed to collect a sample of the fluid delivered via flow line 54. If a multi-sample module is used, the sample rate can be regulated by flow control module N, which is beneficial but not necessary for fluid sampling. With reference to upper sample chamber module S in FIG. 1B, a valve 80 is opened and one of the valves 62 or 62A, 62B is opened (whichever is the control valve for the sampling module) and the formation fluid is directed through the sampling module, into the flow line 54, and into the sample collecting cavity 84C in chamber 84 of sample chamber module S, after which valve 80 is closed to isolate the sample, and the control valve of the sampling module is closed to isolate the flow line 54. The chamber 84 has a sample collecting cavity 84C and a pressurization/buffer cavity 84*p*. The tool can then be moved to a different location and the process repeated. Additional samples taken can be stored in any number of additional sample chamber modules S which may be attached by suitable alignment of valves. For example, there are two sample chambers S illustrated in FIG. 1B. After having filled the upper chamber by operation of shut-off valve 80, the next sample can be stored in the lowermost sample chamber module S by opening shut-off valve 88 connected to sample collection cavity 90C of chamber 90. The chamber 90 has a sample collecting cavity 90C and a pressurization/buffer cavity 90*p*. It should be noted that each sample chamber module has its own control assembly, shown in FIG. 1B as 100 and 94. Any number of sample chamber modules S, or no sample chamber modules, can be used in particular configurations of the tool depending upon the nature of the test to be conducted. Also, sample module S may be a multi-sample module that houses a plurality of sample chambers, as mentioned above.

It should also be noted that buffer fluid in the form of full-pressure wellbore fluid may be applied to the backsides of the pistons in chambers 84 and 90 to further control the pressure of the formation fluid being delivered to the sample modules S. For this purpose, the valves 81 and 83 are opened, and the piston pump 92 of the pump-out module M must pump the fluid in the flow line 54 to a pressure exceeding wellbore pressure. It has been discovered that this action has the effect of dampening or reducing the pressure pulse or "shock" experienced during drawdown. This low shock sampling method has been used to particular advantage in obtaining fluid samples from unconsolidated formations, plus it allows overpressuring of the sample fluid via piston pump 92.

It is known that various configurations of the apparatus A can be employed depending upon the objective to be accomplished. For basic sampling, the hydraulic power module C can be used in combination with the electric power module L, probe module E and multiple sample chamber modules S. For reservoir pressure determination, the hydraulic power module C can be used with the electric power module L and the probe module E. For uncontaminated sampling at reservoir conditions, the hydraulic power module C can be used with the electric power module L, probe module E in conjunction with fluid analysis module D, pump-out module M and multiple sample chamber modules S. A simulated Drill Stem Test (DST) test can be run by combining the electric power module L with the packer module P and the sample chamber modules S. Other configurations are also possible and the makeup of such configurations also depends upon the objectives to be accomplished with the tool. The tool can be of unitary construction a well as modular, however, the modular construction allows greater flexibility and lower cost to users not requiring all attributes.

The individual modules of the apparatus A are constructed so that they quickly connect to each other. Flush connections between the modules may be used in lieu of male/female connections to avoid points where contaminants, common in a wellsite environment, may be trapped Flow control during sample collection allows different flow rates to be used. In low permeability situations, flow control is very helpful to prevent drawing formation fluid sample pressure below its bubble point or asphaltene precipitation point.

Thus, once the tool engages the wellbore wall, fluid communication is established between the formation and the downhole tool. Various testing and sampling operations may then be performed. Typically, a pretest is performed by drawing fluid into the flow line by selectively activating a pretest piston. The pretest piston is retracted so the fluid flows into a portion of the flow line of the downhole tool. The cycling of the piston through a drawdown and buildup phase provides a pressure trace that is analyzed to evaluate the downhole formation pressure, to determine if the packer has sealed properly, and to determine if the fluid flow is adequate to obtain a diagnostic sample.

It follows from the above discussion that the measurement of pressure and the collection of fluid samples from formations penetrated by open boreholes is well known in the relevant art. Once casing has been installed in the borehole, however, the ability to perform such tests is limited. There are hundreds of cased wells which are considered for abandonment each year in North America, which add to the thousands of wells that are already idle. These abandoned wells have been determined to no longer produce oil and gas in necessary quantities to be economically profitable. However, the majority of these wells were drilled in the late 1960's and 1970's and logged using techniques that are primitive by today's standards. Thus, recent research has uncovered evidence that many of these abandoned wells contain large amounts of recoverable natural gas and oil (perhaps as much as 100 to 200 trillion cubic feet) that have been missed by conventional production techniques. Because the majority of the field development costs such as drilling, casing and cementing have already been incurred for these wells, the exploitation of these wells to produce oil and natural gas resources could prove to be an inexpensive venture that would increase production of hydrocarbons and gas. It is, therefore, desirable to perform additional tests on such cased boreholes.

In order to perform various tests on a cased borehole to determine whether the well is a good candidate for production, it is often necessary to perforate the casing to investigate the formation surrounding the borehole. One such commercially-used perforation technique employs a tool which can be lowered on a wireline to a cased section of a borehole, the tool including a shaped explosive charge for perforating the casing, and testing and sampling devices for measuring hydraulic parameters of the environment behind the casing and/or for taking samples of fluids from said environment.

Various techniques have been developed to create perforations in cased boreholes, such as the techniques and perforating tools that are described, for example, in U.S. Pat. Nos. 5,195,588; 5,692,565; 5,746,279; 5,779,085; 5,687,806; and 6,119,782, all of which are assigned to the assignee of the present invention.

The '588 patent by Dave describes a downhole formation testing tool which can reseal a hole or perforation in a cased borehole wall. The '565 patent by MacDougall et al. describes a downhole tool with a single bit on a flexible shaft for drilling, sampling through, and subsequently sealing multiple holes of a cased borehole. The '279 patent by Havlinek et al. describes an apparatus and method for overcoming bit-life limitations by carrying multiple bits, each of which are employed to drill only one hole. The '806 patent by Salwasser et al. describes a technique for increasing the weight-on-bit delivered by the bit on the flexible shaft by using a hydraulic piston.

Another perforating technique is described in U.S. Pat. No. 6,167,968 assigned to Penetrators Canada. The '968 patent discloses a rather complex perforating system involving the use of a milling bit for drilling steel casing and a rock bit on a flexible shaft for drilling formation and cement.

Despite such advances in formation evaluation and perforating systems, a need exists for a downhole tool that is capable of perforating the sidewall of a wellbore and performing the desired formation evaluation processes. Such a system is also preferably provided with a probe/packer system capable of supporting the perforating tool and/or pumping capabilities for drawing fluid into the downhole tool. It is further desirable that this combined perforating and formation evaluation system be provided with a bit system capable of even long term use, and be adaptable to perform in a variety of wellbore conditions, such as cased or open hole wellbores. It is further desirable that such as system provide a probe/packer assembly that is less prone to the problems of differential sticking of the tool body to the borehole wall, and reduces the risk of damaging the probe assembly during conveyance. It is further desirable that such a system have the ability to perforate a selective distance into the formation, sufficient to reach beyond the zone immediately around the borehole which may have had its permeability altered, reduced or damaged due to the effects of drilling the borehole, including pumping and invasion of drilling fluids.

SUMMARY OF THE INVENTION

In one aspect, the present invention provides an apparatus for characterizing a subsurface formation, including a tool body adapted for conveyance within a borehole penetrating the subsurface formation. A probe assembly is carried by the tool body for sealing off a region of the borehole wall. The phrase "probe assembly" is used hereinafter to describe the present invention in such a manner as to encompass the use of probes, packers, and a combination thereof. An actuator is employed for moving the probe assembly between a retracted position for conveyance of the tool body and a deployed position for sealing off a region of the borehole wall. A perforator is employed for penetrating a portion of the sealingly engaged region of the borehole wall.

In a particular embodiment, the inventive apparatus further includes a flow line extending through a portion of the tool body and fluidly communicating with at least one of the perforator, the actuator, the probe assembly, and a combination thereof for admitting formation fluid into the tool body. A pump is also carried within the tool body for drawing formation fluid into the tool body via the flow line. A sample chamber may further be carried within the tool body for receiving formation fluid from the pump. Additionally, an instrument may be carried within the tool body for analyzing formation fluid drawn into the tool body via the flow line and the pump.

The tool body of the inventive apparatus is adapted for conveyance within a borehole via a wireline in the manner of conventional formation testers, or via a drillstring for use during periods of drilling cessation in highly deviated holes or where sticking is an issue.

The probe assembly includes, in a particular embodiment, a pair of inflatable rings each carried about axially-separated portions of the tool body and adapted for sealingly engaging axially-separated annular regions of the borehole wall. The actuator includes a hydraulic system for selectively inflating and deflating the packer rings.

In another embodiment of the inventive apparatus, the probe assembly is adapted for sealingly engaging a region of the borehole wall adjacent one side of the tool body. Accordingly, this embodiment further includes an anchor system for supporting the tool body against a region of the borehole wall opposite the one side of the tool body. The probe assembly of this embodiment preferably includes a substantially rigid plate, and a compressible packer element mounted upon the plate. The actuator of this embodiment preferably includes a plurality of pistons connected to the probe plate for moving the probe assembly between the retracted and deployed positions, and a controllable energy source for powering the pistons. The controllable energy source preferably includes a hydraulic system.

In a particular embodiment of the inventive apparatus, the perforator includes at least one drilling shaft having a drill bit connected to an end thereof for penetrating a portion of the sealed-off region of the borehole wall, and a drilling motor assembly for applying torque and translatory force to the drilling shaft. The shaft(s) may be flexible or rigid, depending on the particular application. Thus, e.g., if an extended lateral perforation is required, a rigid shaft may not be suitable because the length of a rigid shaft will be restricted by the diameter of the tool body. It is preferred that the perforator of this embodiment further includes a tubular guide for directing the translatory path of the drilling shaft so as to effect a substantially normal penetration path by the drill bit through the borehole wall.

In a particular embodiment, the tubular guide is flexible and is connected at one end to the drilling motor assembly and is connected at another end to the probe assembly. Alternatively, the tubular guide is defined by a channel extending through a portion of the tool body. In the alternative embodiment, the tubular guide may include a laterally-protuberant portion of the tool body through which a portion of the channel extends, or it may include a substantially rigid tubular portion of the probe assembly that is concentric with a portion of the channel.

In various embodiments of the inventive apparatus, the perforator includes at least one of an explosive charge, a hydraulic punch, a coring bit, and a combination thereof.

In another aspect, the present invention relates to a method for characterizing a subsurface formation, including the steps of sealing off a region of a wall of a borehole penetrating the formation, and perforating a portion of the sealed-off region of the borehole wall to facilitate testing of the formation.

The inventive method preferably further includes the steps of collecting a sample of formation via the perforated portion of the borehole wall, and analyzing the collected sample of formation fluid.

In another aspect, the present invention relates to an apparatus for perforating a cased borehole penetrating a subsurface formation, including a tool body adapted for conveyance within the cased borehole. A first drilling shaft has a first drill bit connected to an end thereof for perforating a portion of the casing lining the borehole wall, and a second drilling shaft has a second drill bit connected to an end thereof for extending through the perforation in the casing and perforating a portion of the borehole wall. A drilling motor assembly is employed for applying torque and translatory force to the first and second drilling shafts, and a coupling assembly is employed for selectively coupling the drilling motor assembly to the first drilling shaft, the second drilling shaft, or a combination thereof.

An anchor system is preferably carried by the tool body for supporting the tool body within the borehole. The anchor system is preferably deployable by means such as a hydraulic system.

In a particular embodiment, the coupling assembly includes a gear assembly operatively connected to both the first and second drilling shafts. At least one of the drilling shafts of this embodiment is selectively operatively connected to the gear train.

In another embodiment, the second drilling shaft has a defined drilling path, and the coupling assembly includes a bit coupling connected to an end of the first drilling shaft opposite the first drill bit, and a means for selectively moving the first drilling shaft between a holding position and a drilling position. The drilling position is located in the drilling path of the second drilling shaft, thereby enabling the second drill bit to engage the bit coupling and drive the first drilling shaft. The moving means may move the first drilling shaft by a pivoting motion or by a translatory motion.

In a further embodiment, the first and second drilling shafts have respective defined drilling paths, and the coupling assembly includes a bit coupling connected to an end of the first drilling shaft opposite the first drill bit, and a means for selectively moving the second drilling shaft from its drilling path to the drilling path of the first drilling shaft, thereby enabling the second drill bit to engage the bit coupling and drive the first drilling shaft.

A further aspect of the present invention relates to a method for perforating a cased borehole penetrating a subsurface formation, including the step of perforating a portion of the casing lining the borehole wall using a drilling motor assembly and a first drilling shaft having a first drill bit connected to an end thereof, and extending a second drilling shaft through the perforation in the casing using the drilling motor assembly. The second drilling shaft has a second drill bit connected to an end thereof for penetrating the formation. A portion of the borehole wall is then perforated using the drilling motor assembly and the second drilling shaft with the second drill bit. The first and second drilling shafts are selectively coupled to the drilling motor assembly to execute the perforating and extending steps.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 2:
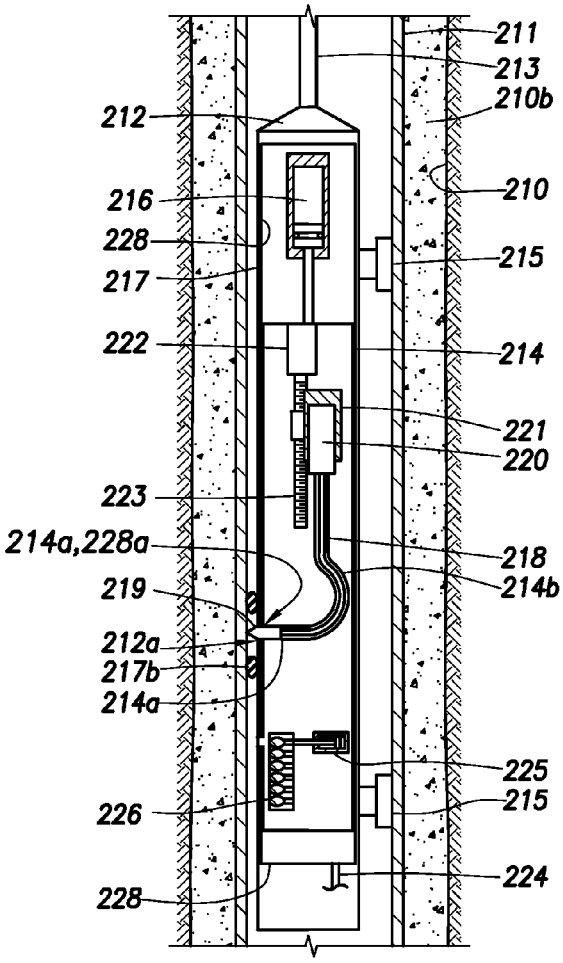
FIG. 2 is a schematic illustration of a prior art formation tester for use in cased hole environments.

FIG. 2 depicts a perforating tool 212 for formation evaluation. The tool 212 is suspended on a cable 213, inside steel casing 211. This steel casing sheathes or lines the borehole 210 and is supported with cement 210*b*. The borehole 210 is typically filled with a completion fluid or water. The cable length substantially determines the depths to which the tool 212 can be lowered into the borehole. Depth gauges can determine displacement of the cable over a support mechanism (e.g., sheave wheel) and determines the particular depth of the logging tool 212. The cable length is controlled by a suitable known means at the surface such as a drum and which mechanism (not shown). Depth may also be determined by electrical, nuclear or other sensors which correlate depth to previous measurements made in the well or to the well casing. Also, electronic circuitry (not shown) at the surface represents control communications and processing circuitry for the logging tool 212. The circuitry may be of known type and does not need to have novel features.

The tool 212 of FIG. 2 is shown having a generally cylindrical body 217 equipped with a longitudinal cavity 228 which encloses an inner housing 214 and electronics. Anchor pistons 215 force the tool-packer 217*b* against the casing 211 forming a pressure-tight seal between the tool and the casing and serving to keep the tool stationary.

The inner housing 214 contains the perforating means, testing and sampling means and the plugging means. This inner housing is moved along the tool axis (vertically) through the cavity 228 by the housing translation piston 216 secured to a portion of the body 217 but also disposed with in the cavity 228. This movement of the inner housing 214 positions, in the respective lower-most and upper-most positions, the components of the perforating and plugging means in lateral alignment with the lateral body opening 212*a* within the packer 217*b*. Opening 212*a* communicates with the cavity 228 via an opening 228*a* into the cavity.

A flexible shaft 218 is located inside the inner housing and conveyed through a tubular guide channel 214*b* which extends through the housing 214 from the drive motor 220 to a lateral opening 214*a* in the housing. A drill bit 219 is rotated via the flexible shaft 218 by the drive motor 220. This motor is held in the inner housing by a motor bracket 221, which is itself attached to a translation motor 222. The translation motor moves drive motor 220 by turning a threaded shaft 223 inside a mating nut in the motor bracket 221. The flex shaft translation motor thus provides a downward force on the drive motor 220 and the flex shaft 218 during drilling, thus controlling the penetration. This drilling system allows holes to be drilled which are substantially deeper than the tool diameter, but alternative technology (not shown) may be employed if necessary to produce perforations of a depth somewhat less than the diameter of the tool.

For the purpose of taking measurements and samples, a flow line 224 is also contained in the inner housing 214. The flow line is connected at one end to the cavity 228—which is open to formation pressure during perforating—and is otherwise connected via an isolation valve (not shown) to the main tool flow line (not shown) running through the length of the tool which allows the tool to be connected to sample chambers.

A plug magazine (or alternatively a revolver) 226 is also contained in the inner housing 214. After formation pressure has been measured and samples taken, the housing translation piston 216 shifts the inner housing 214 to move the plug magazine 226 into position aligning a plug setting piston 225 with openings 228*a*, 212*a* and the drilled hole. The plug setting piston 225 then forces one plug from the magazine into the casing, thus resealing the drilled hole. The integrity of the plug seal may be tested by monitoring pressure through the flow line while a "drawdown" piston is actuated. The resulting pressure should drop and then remain constant at the reduced value. A plug leak will be indicated by a return of the pressure to formation pressure after actuating the drawdown piston. It should be noted that this same testing method is also used to verify the integrity of the tool-packer seal before drilling commences. The sequence of events is completed by releasing the tool anchors. The tool is then ready to repeat the sequence.

Figure 3:
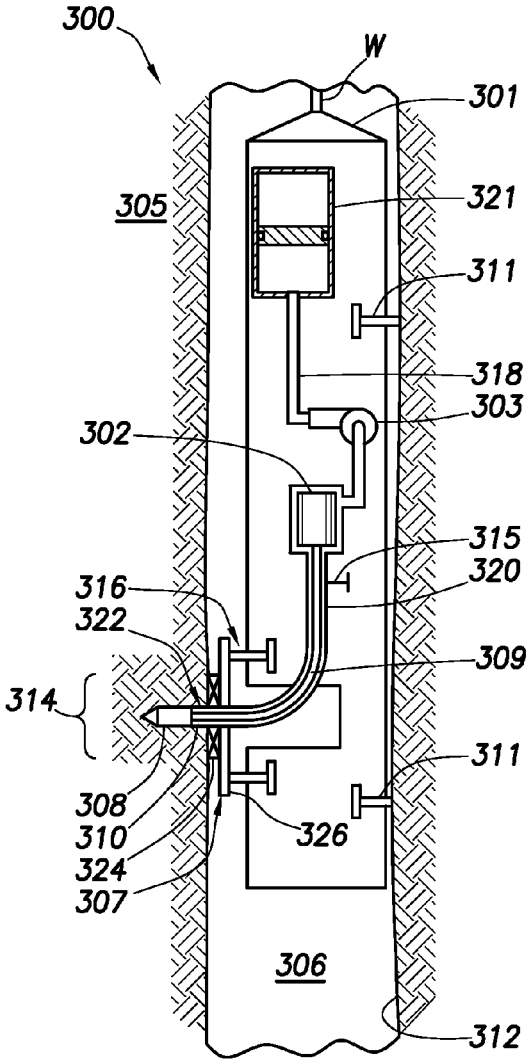
FIG. 3 is schematic illustration of an improved formation tester for use in open hole or cased hole environments in accordance with the present invention.

FIG. 3 depicts a downhole formation evaluation tool 300 positioned in an open hole wellbore. The tool includes a body 301 adapted for conveyance within a borehole 306 penetrating the subsurface formation 305. The tool body 301 is well adapted for conveyance within a borehole via a wireline W, in the manner of conventional formation testers, but is also adaptable for conveyance within a drillstring (i.e., conveyed while drilling). The apparatus is anchored and/or supported against the side of the borehole wall 312 opposite a probe assembly 307 by actuating anchor pistons 311.

The probe assembly (also referred to as simply "probe") 307 is carried by the tool body 301 for sealing off a region 314 of the borehole wall 312. A piston actuator 316 is employed for moving the probe assembly 307 between a retracted position (not shown in FIG. 3) for conveyance of the tool body and a deployed position (shown in FIG. 3) for sealing off the region 314 of the borehole wall 312. The actuator of this embodiment preferably includes a plurality of pistons connected to the probe assembly 307 for moving the probe between retracted and deployed positions, and a controllable energy source (preferably a hydraulic system) for powering the pistons. The probe assembly 307 preferably includes a compressible packer 324 mounted to a piston-deployed plate 326 to create the seal between the borehole wall 312 and the formation of interest 305.

A perforator, including a flexible drilling shaft 309 equipped with drill bit 308 and driven by a motor assembly 302, is employed for penetrating a portion of the sealed-off region 314 of the borehole wall 312 bounded by the packer 324. The flexible shaft 309 conveys rotational and translational power to the drill bit 308 from the drive motor 302. The action of the perforator results in lateral bore or perforation 310 extending partially through the formation 305.

The tool 301 further includes a flow line 318 extending through a portion of the tool and fluidly communicating with the formation 305, via perforation 310, by way of the perforator pathway 320 and the pathway 322 defined by the actuator and the packer (both pathways considered to be extended components of the flow line 318) for admitting formation fluid into the tool body 301. A pretest piston 315 is also connected to flow line 320 to perform pretests.

Figure 1A:
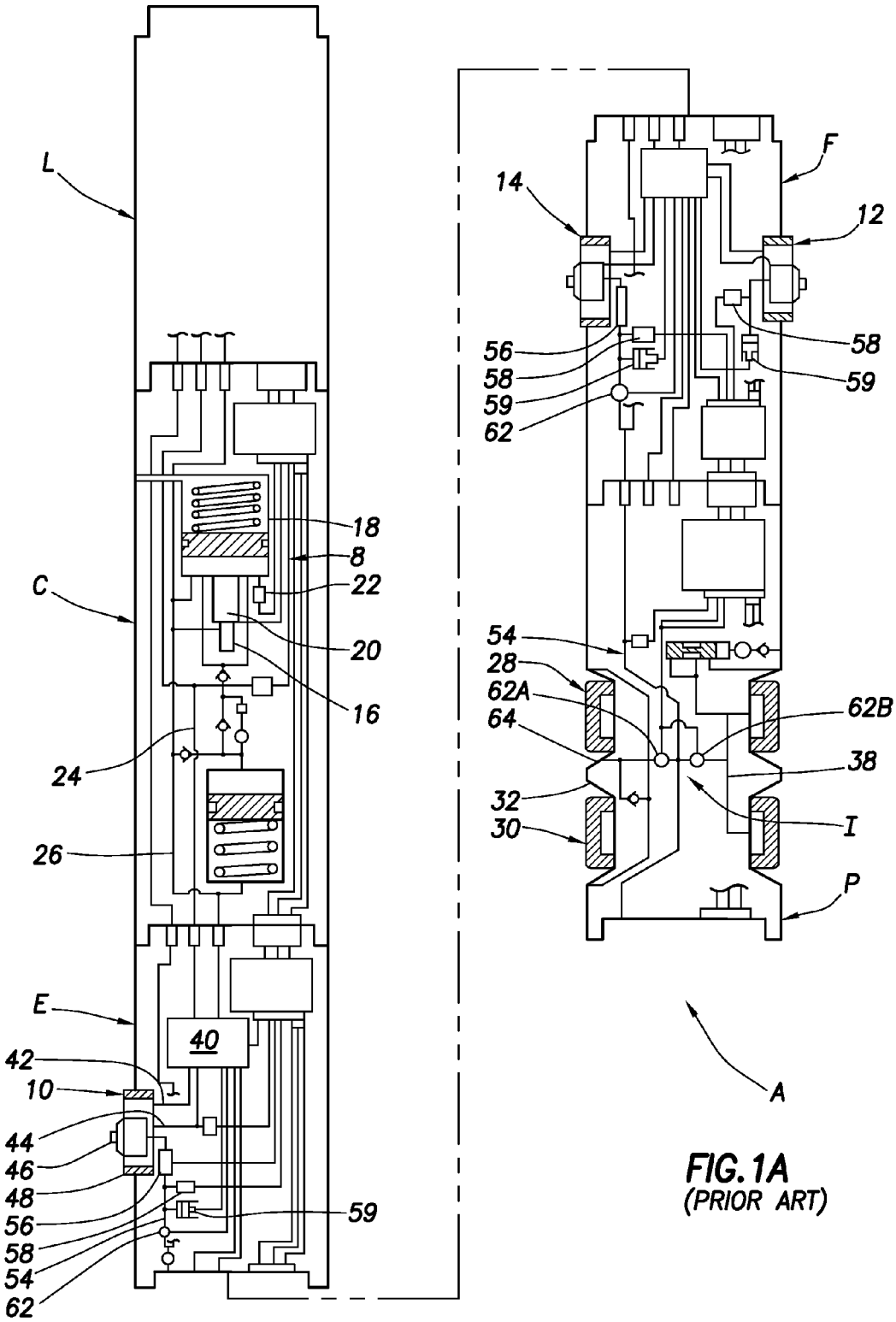
FIG. 1A (PRIOR ART)
FIGS. 1A-1B are schematic illustrations of a prior art formation tester for use in open hole environments.
Figure 1B:
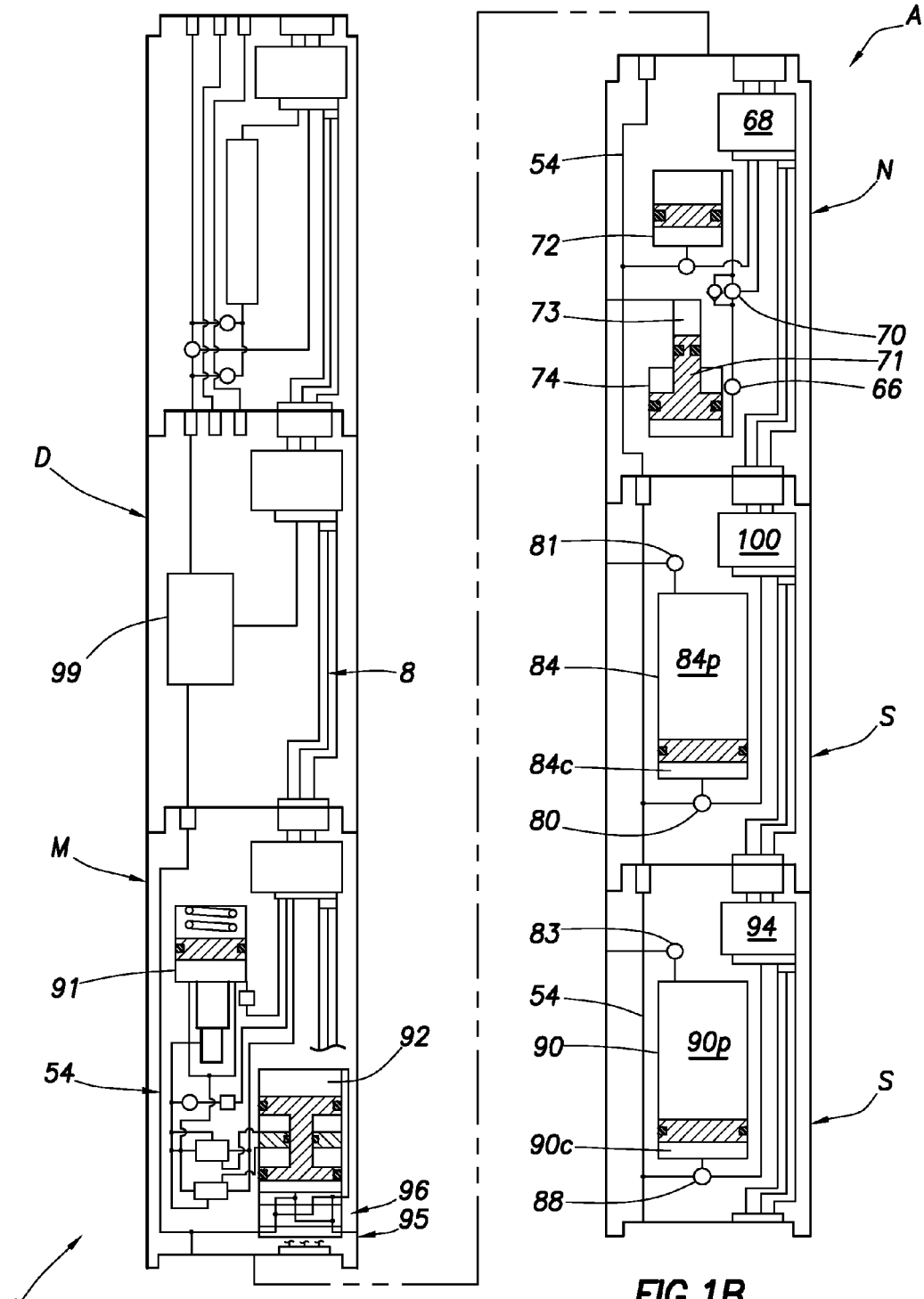
FIG. 1B (PRIOR ART)

A pump 303 is also carried within the tool body for drawing formation fluid into the tool body via the flow line 318. A sample chamber 321 is further carried within the tool body 301 for receiving formation fluid from the pump 303. Additionally, instruments may be carried within the tool body 301 for measuring pressure, and for analyzing formation fluid drawn into the tool body (e.g., like optical fluid analyzer 99 from FIG. 1) via the flow line 318 and the pump 303.

Once the perforation(s) or hole(s) 310 have been created, the flow line 318 can freely communicate formation fluid to these components for downhole evaluation and/or storage. The pump 303 is not essential, but is quite useful for controlling the flow of formation fluid through the flow line 318. Formation evaluation and sampling may occur at multiple hole-penetration depths by drilling further into the formation 305. Preferably, such a hole extends through the damaged zone surrounding the borehole 306 and into the connate fluid zone of the formation 305.

Figure 4B:
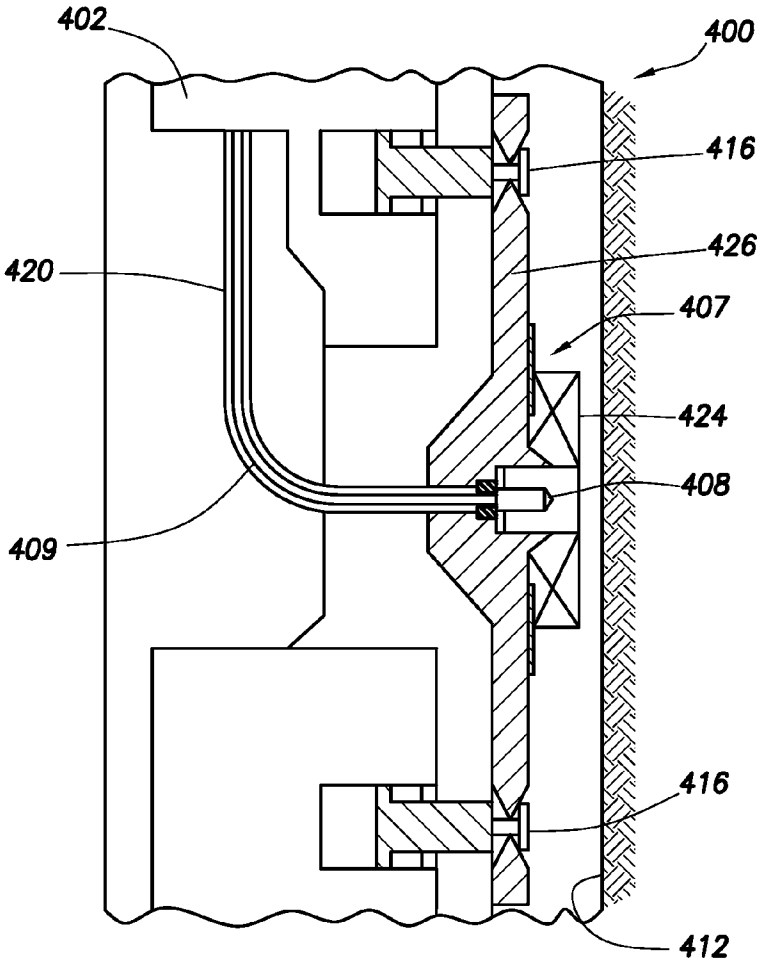
FIGS. 4A-4B are detailed sequential illustrations, partially in section, of one embodiment of a deployable probe assembly in accordance with one aspect of the present invention.
Figure 4A:
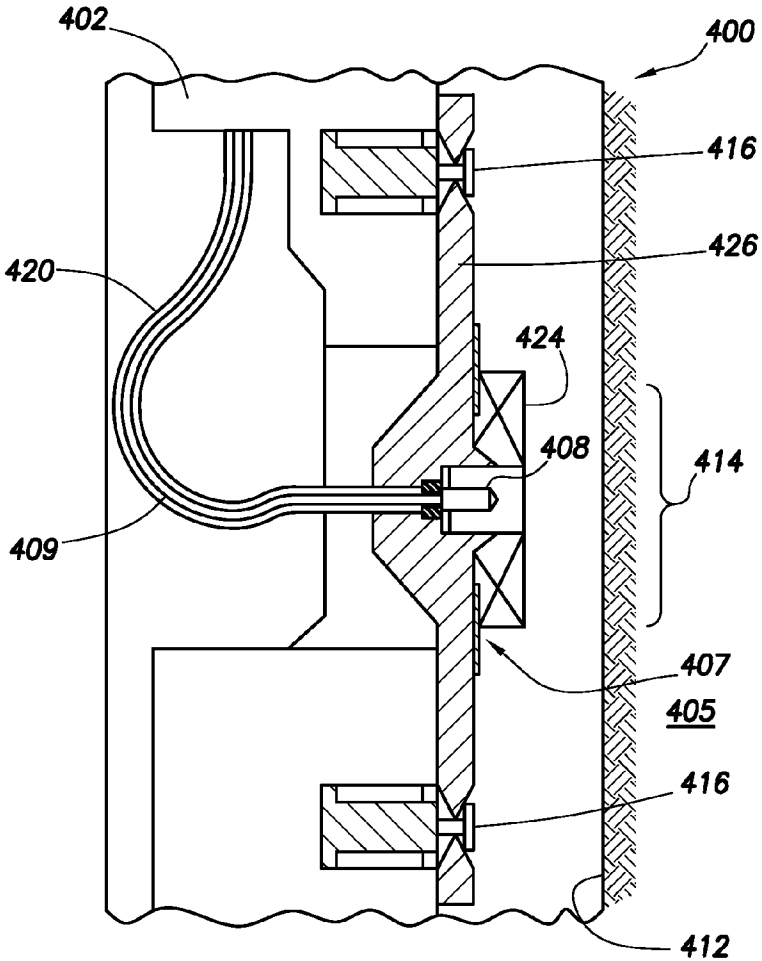

Turning now to FIGS. 4A-4B, an alternate formation evaluation tool 400 is depicted. FIG. 4A shows the probe assembly 407 in the retracted position for conveyance of the tool 400. FIG. 4B shows the probe assembly 407 moving towards the extended position for sealing off a region of the borehole wall 412. The tool 400 employs a perforator that includes at least one flexible drilling shaft 409 equipped with a drill bit 408 at an end thereof for penetrating a portion of the sealed-off region 414 of the borehole wall 412 (and casing and cement if present). It is preferred that the drill bit 408 of this embodiment be made from diamond for open-hole use, but will preferably employ other materials (e.g., tungsten carbide) for cased-hole use (described in detail below), which improves the ability to penetrate the formation 405 to a desired lateral depth. A drilling motor assembly 402 is provided for applying torque and translatory force to the drilling shaft 409. The perforator of this embodiment further includes a semi-rigid tubular guide 420 for directing the translatory path of the flexible drilling shaft 409, so as to effect a substantially normal penetration path by the drill bit through the borehole wall 412.

As illustrated by the sequence of FIGS. 4A-4B, the tubular guide 420 is semi-flexible, permitting it to flex and move with the deployment of the probe assembly 407. The hydraulically-induced force of the pistons 416 deploy and compresses the packer element 424 against the wall 412 of the borehole 405. The tubular guide 420 is connected at one end to the drilling motor assembly 402, and is connected at another end to the probe assembly 407. The tubular guide 420 serves two purposes. First, it provides sufficient rigidity to impose a reactive force on the flexible shaft 409 that permits the shaft to move under the force provided by the drive motor 402. Second, the tubular guide 420 connects a flow line (not shown in FIGS. 4A-4B) in the apparatus 400 to probe plate 426, and thus acts as an extension of the tool's flow line.

Figure 5B:
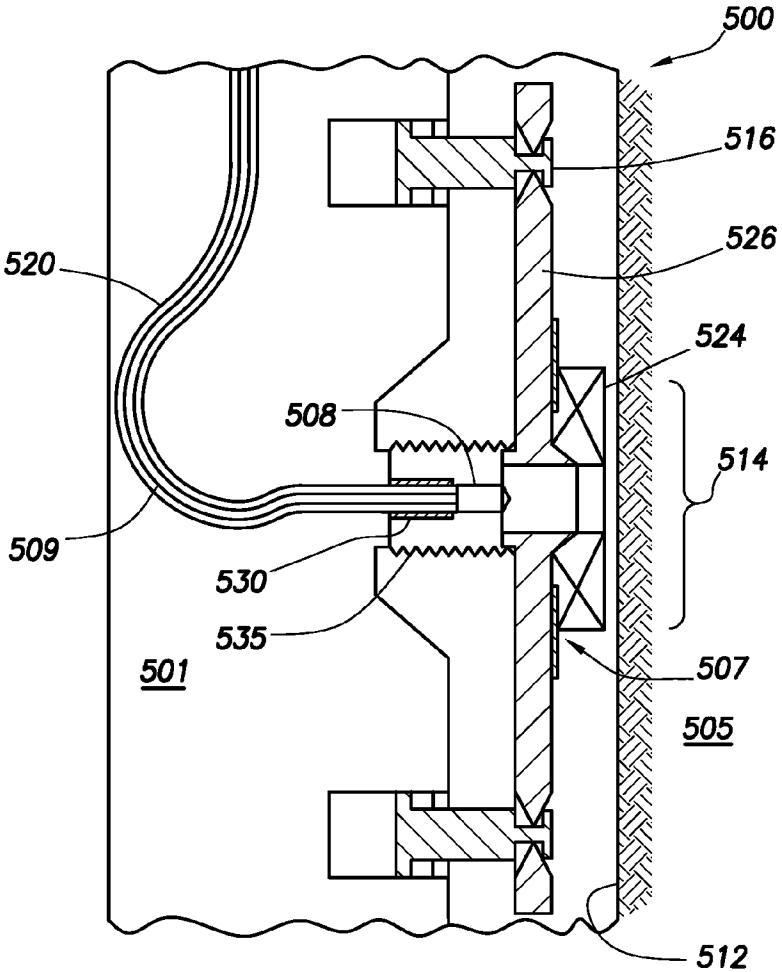
FIGS. 5A-5B are detailed sequential illustrations, partially in section, of a second embodiment of the deployable probe assembly.
Figure 5A:
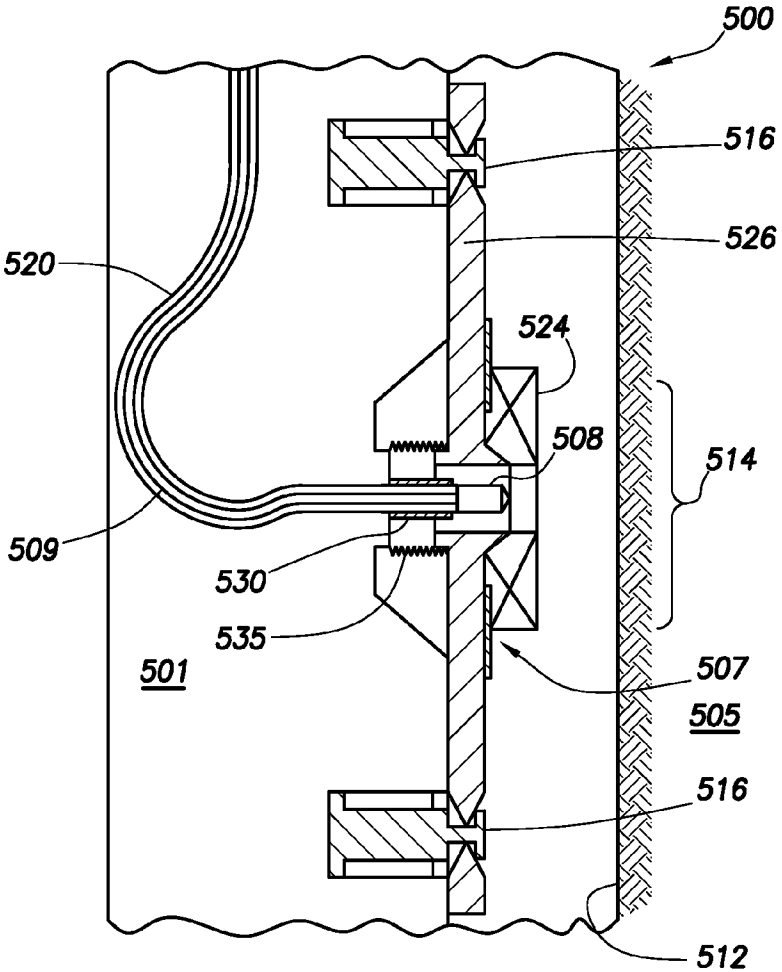

FIGS. 5A-5B depict another alternate formation evaluation tool 500 conveyed within a borehole penetrating a formation 505. FIG. 5A shows the probe assembly 507 in the retracted position. FIG. 5B shows the probe assembly 507 moving towards the extended position for engagement with the wellbore wall. The tool includes a tubular guide 520 defined by a channel extending through a portion of the tool body 501. In this alternative embodiment, the tubular guide includes a laterally-protuberant portion 530 of the tool body 501 through which a portion of the guide-defining channel extends. In this manner, bit 508 at the end of the flexible drilling shaft 509 is guided through the central opening in the probe assembly 507 towards the borehole wall 512. A bellows 535 is used to fluidly connect the tubular guide 520 (which serves as part of a flow line within the tool) in the tool body 500 to the probe assembly 507 as the probe assembly is deployed by the action of hydraulic pistons 516 on probe plate 526, compressing packer element 524 against the wall 512 of the formation 505 to seal off the region 514.

Figure 6B:
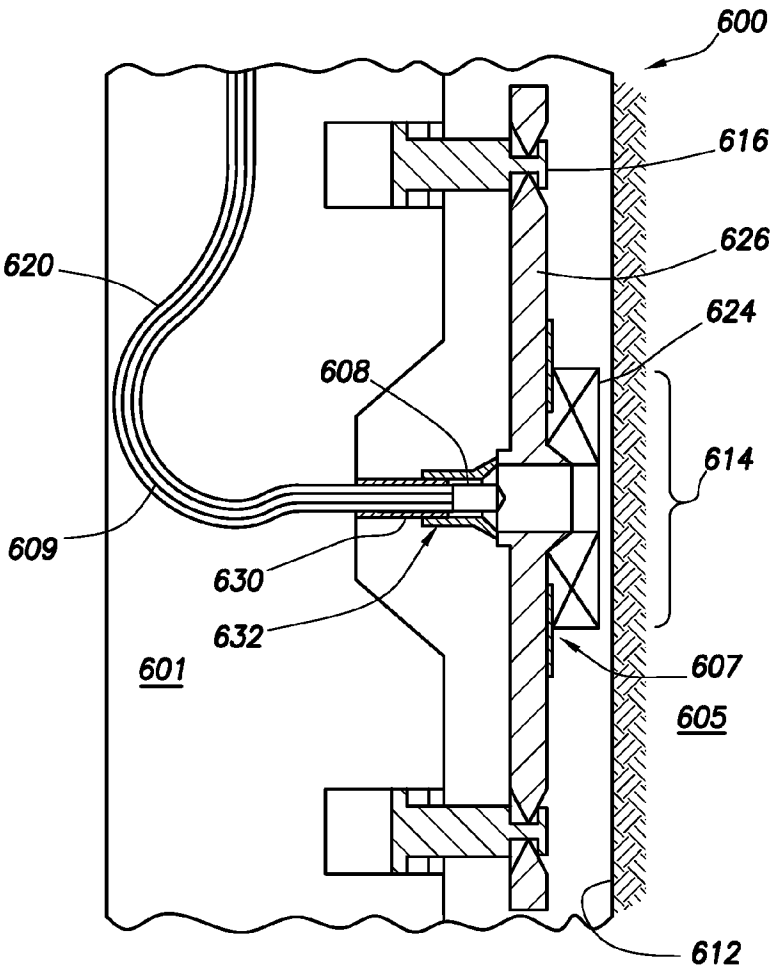
FIGS. 6A-6B are detailed sequential illustrations, partially in section, of a third embodiment of the deployable probe assembly.
Figure 6A:
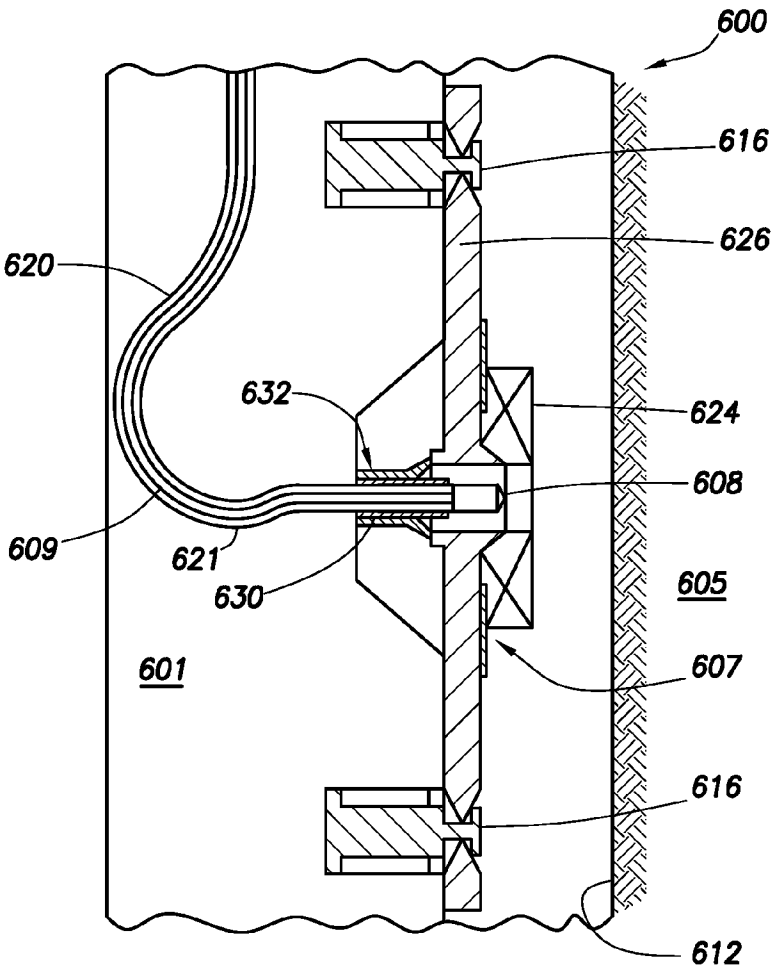

A further alternative formation evaluation tool 600 being conveyed in a borehole penetrating a formation 605 is illustrated in FIGS. 6A-6B. FIG. 6A shows a probe assembly 607 in the retracted position, while FIG. 6B shows the probe assembly 607 moving to the extended position for engagement with the wellbore wall 612. Pistons 616 are provided to extend and retract the probe assembly 607. A tube guide 620 includes a substantially rigid tubular portion 632 of the probe assembly 607 that is concentric with a portion of the channel 621 that substantially defines the tubular guide 620. The tubular portion 632 may be used to fluidly connect the tool body 601 (more particularly, tubular guide 620) to the probe assembly 607. Thus, when pistons 616 deploy the probe plate 626 towards the borehole wall 612 so as to compress the packer element 624 and seal of a region 614 (see FIG. 6B) the perforation (not shown) formed by flexible shaft 609 and drill bit 608 conducts fluid from the formation 605 to the tool 600. The tubular portion 632 is preferably flexible so as to bend as the probe assembly 607 is deployed, such that the tubular portion 632 maintains physical engagement with the lateral protuberant portion 630 of the tool body 601, thereby maintaining the fluid connection with the tool body 601. The addition of a spherical joint (not shown) between the sliding tubular portion 632 and the probe plate 626 may reduce the preference of the sliding tubular portion 632 to be bendable.

Figure 7:
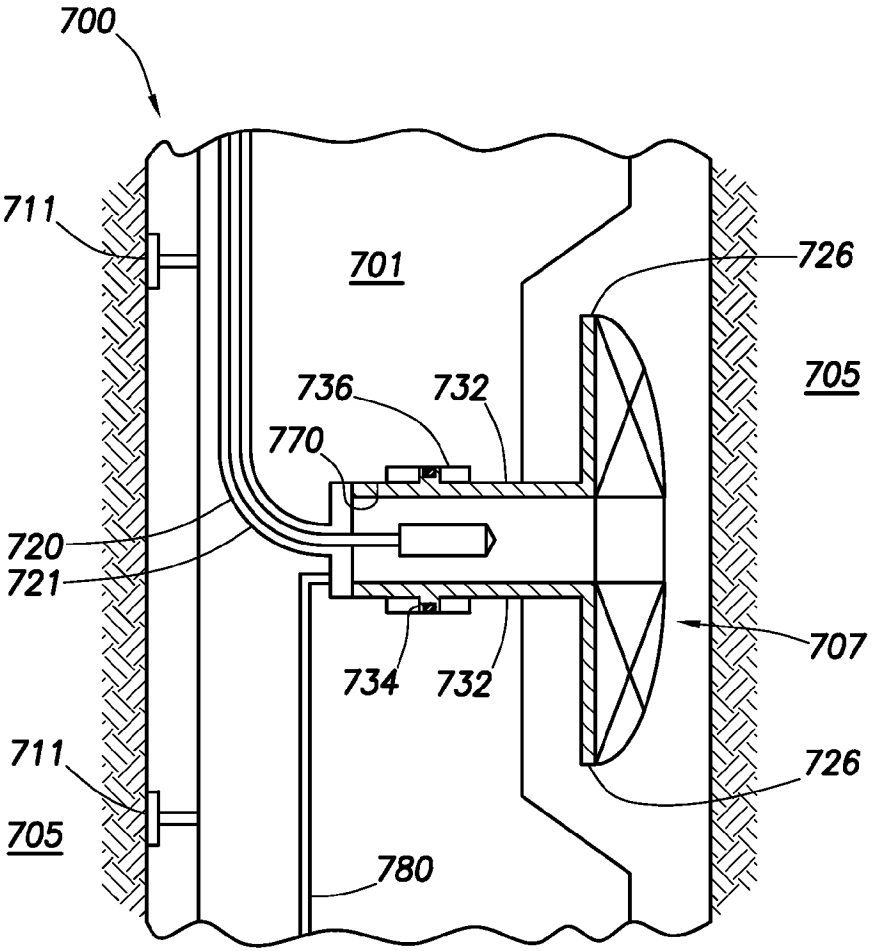
FIG. 7 is a detailed illustration, partially in section, of a fourth embodiment of the deployable probe assembly.

FIG. 7 depicts another alternate formation evaluation tool 700 including a tool body 701 conveyed in a borehole penetrating a formation 705. This alternative is similar to that of FIGS. 6A-6B, in that a tubular guide 720 includes a substantially rigid tubular portion 732 of a probe assembly 707 that is concentric with a portion of the channel 721 that substantially defines the tubular guide 720. The primary differences here are that the probe plate 726 is relatively narrow, and the rigid tubular portion 732 of the probe assembly 707 also serves as an actuator piston (see annular protuberance 734 within hydraulically-pressurized annulus 736). FIG. 7 also shows an anchoring system 711 for positioning and supporting the tool 700 within the borehole. One further difference is the use of a separate flow line 780 that is connected at one end thereof to a cavity 770 within which the probe portion 732 is reciprocated. The flow line 780 is otherwise connected via an isolation valve (not shown) to the main tool flow line (not shown) running through the length of the tool which allows the tool to be connected to sample chambers. Thus, in this embodiment, the tubular guide 720 does not serve as a means for sampling formation fluid (although the tubular guide may experience formation pressure).

Figure 8:
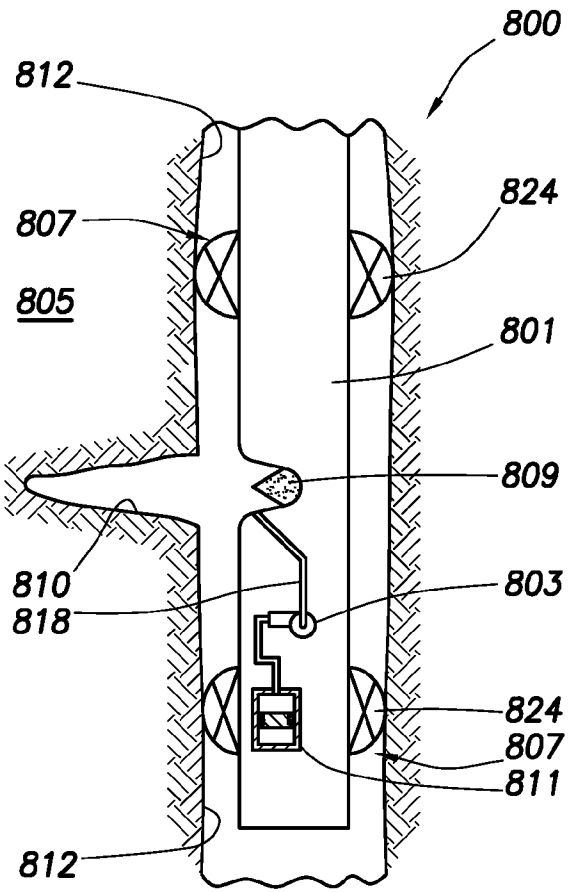
FIG. 8 is a schematic illustration of an improved formation tester employing dual inflatable packers in accordance with another aspect of the present invention.

FIG. 8 depicts another alternate formation evaluation tool 800 disposed in a borehole 812 penetrating a formation 805. In this embodiment, the probe assembly 807 includes a pair of inflatable packers 824 each carried about axially-separated portions of the tool body 801. The packers 824 are well adapted for sealingly engaging axially-separated annular regions of the borehole wall 812. In this embodiment, the actuator for the assembly 800 includes a hydraulic system (not shown) for selectively inflating and deflating the packers 824.

FIG. 8 further illustrates an alternative perforator having utility in the present invention. Thus, explosive charge 809 is useful for creating a perforation 810 in the formation 805. Other suitable perforating means include a hydraulic punch and a coring bit, either of which are useful for creating perforations through the borehole wall. Thus, the embodiment shown is effective for admitting formation fluid into flow line 818 for collection in a sample chamber 811 with the aid of a pump 803.

FIGS. 9-12 depict alternative versions of a dual drill bit assembly usable in connection with perforating tools, such as the perforating tools of FIGS. 2 and 3. As shown in FIG. 9A, the dual bit assembly may be used to penetrate the wall 912 of a borehole 906 penetrating a subsurface formation 905. The borehole 906 may be equipped with a casing string 936 secured by concrete 938 filling the annulus between the casing and the borehole wall. An anchor system 911 is carried by the tool 900 for supporting the tool within the cased borehole 906, or more particularly within the casing string 936.

Figure 9A:
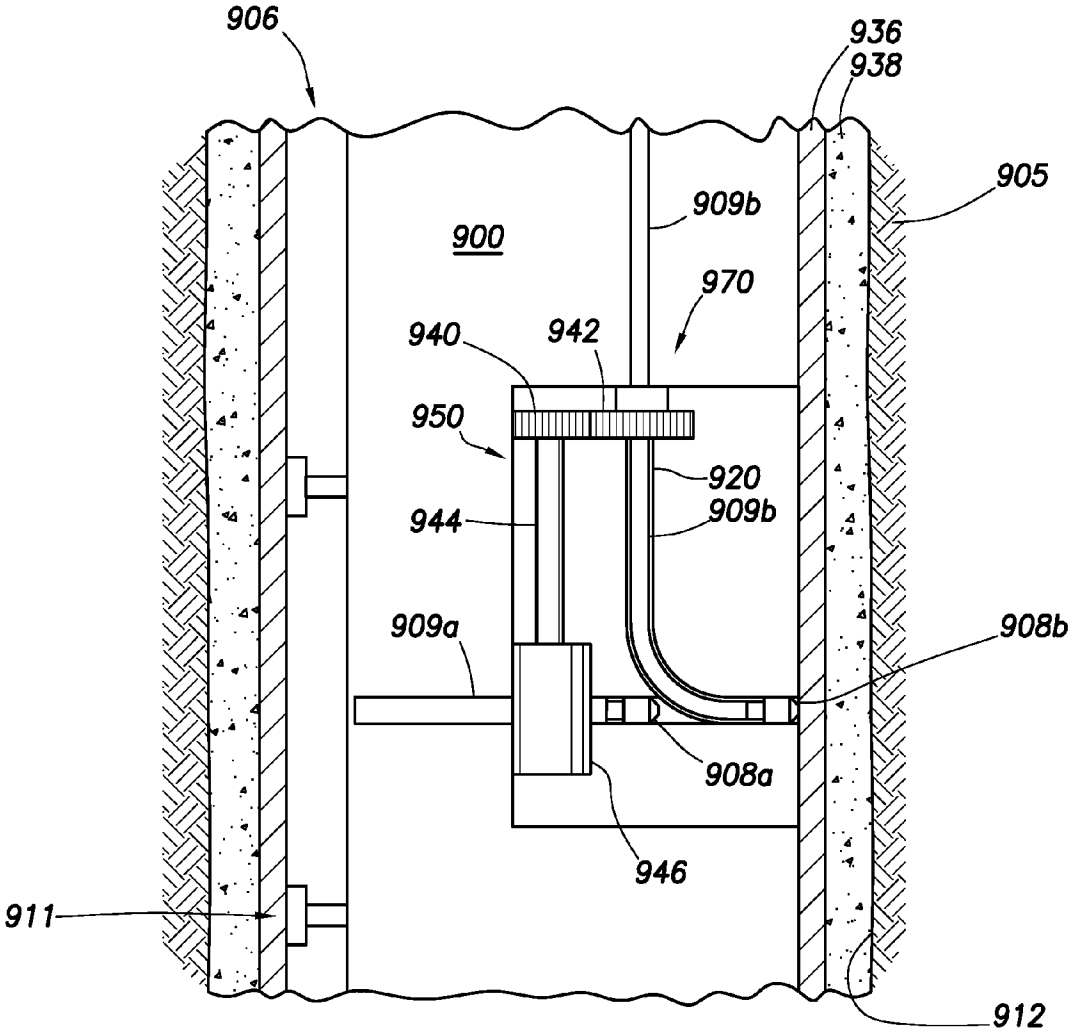
FIGS. 9A, 9B, and 9C are detailed sequential illustrations, partially in section, of one embodiment of a dual bit configuration for perforating the walls of a cased hole in accordance with another aspect of the present invention.
Figure 9C:
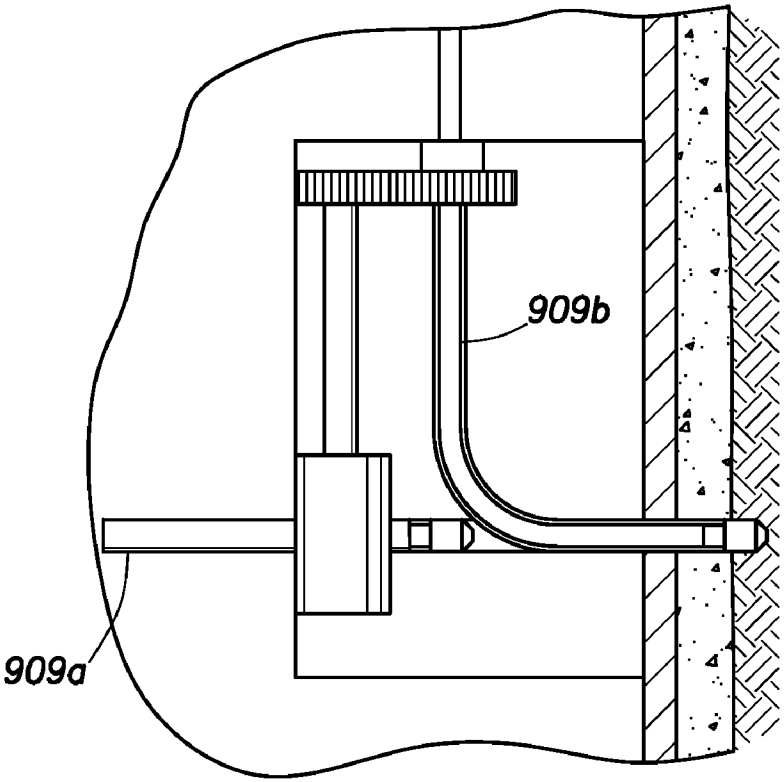
Figure 9B:
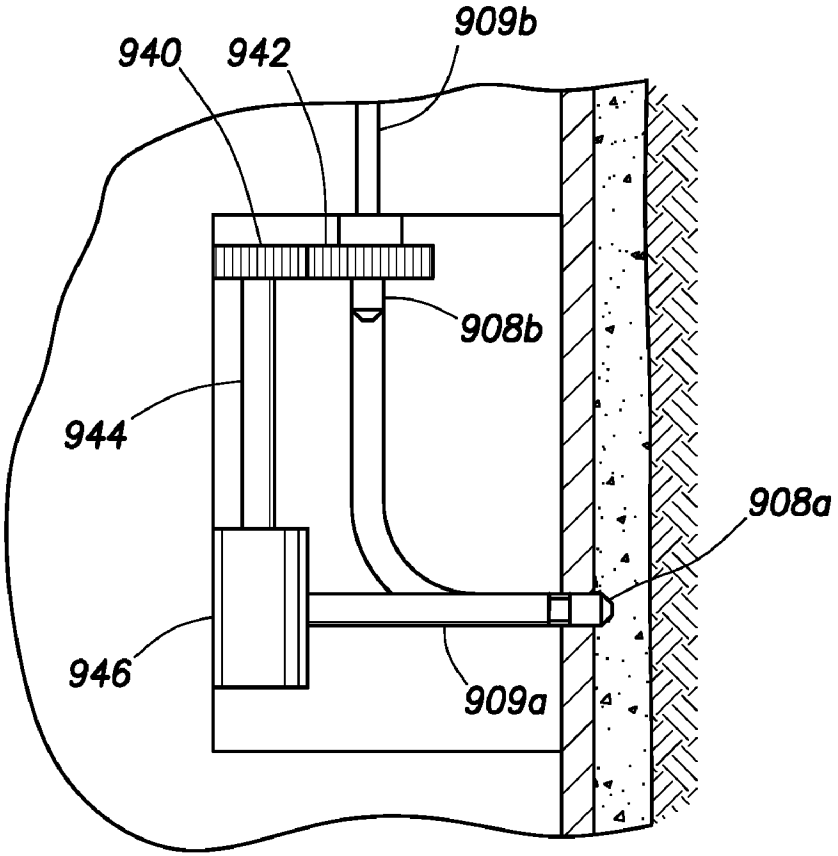

An embodiment of the dual drill bit perforating assembly 970 is shown in FIGS. 9A-9C as including a tool body 900 adapted for conveyance within a borehole, such as the cased borehole 906 having a borehole wall 912. FIG. 9A depicts the dual bit system in the retracted position for conveyance within a borehole. FIG. 9B depicts the system in a first drilling configuration. FIG. 9C depicts the system in a second drilling configuration. This apparatus uses a dual bit system to drill successive, collinear holes through the sidewall 912 of the borehole and the formation (essentially rock) together with casing and cement if present. A first drilling shaft 909*a* has a first drill bit 908*a* connected to an end thereof. The first bit is preferably suited for perforating a portion of the steel casing 936 lining the borehole wall 912. A second drilling shaft 909*b*, which is flexible, has a second drill bit 908*b* connected to an end thereof. The second drill bit is preferably suited for extending through a perforation formed in the casing 936 and perforating the concrete layer 938 and a portion of the formation 905. A drilling motor assembly (not shown) is employed for applying torque and translatory force to the first and second drilling shafts 909*a*, 909*b*.

A mechanism, in the form of a coupling assembly 950, provides the means by which both drilling shafts 909*a*, 909*b* can be driven from a single motor drive. The coupling assembly includes a set of engaging spur gears 940, 942, an intermediate shaft 944, and a right-angle gear box 946. The coupling assembly is useful for selectively coupling the drilling motor assembly to the first and second drilling shafts. The second drilling shaft 909*b* is selectively operatively connected to the gear train whereby torque applied to the second drilling shaft 909*b* by the drilling motor assembly is preferably not transferred through the coupling gear train 950 to the first drilling shaft 909*a* unless the second drilling shaft 909*b* is retracted sufficiently to dispose the second drill bit 908*b* into engagement with the spur gear 942.

Thus, for example, for drilling through the steel casing, the second (flexible) drilling shaft 909*b* may be retracted within the tubular guide 920 until the second drill bit 908*b* engages spur gear 942, as shown in FIG. 9B. This engagement induces rotation of intermediate rotary shaft 944. This rotary shaft in turn drives the first drilling shaft 909*a*, through the right angle gear mechanism 946. The first drilling shaft 909*a* is mechanically coupled to the first drill bit 908*a*, which is preferably a carbide bit suitable for drilling steel. A hydraulic piston (not shown) may be employed with a thrust bearing to increase the weight on bit to a level necessary to drill the steel casing 936.

Once the casing has been perforated, the concrete layer 938 and the formation 905 are drilled by reversing the direction of the translation motor to retract the first drilling shaft 909*a* and/or by retracting the hydraulic piston (if provided). This retraction step creates enough room for the second (flexible) drilling shaft 909*b* to be inserted through the hole in the casing 936, as shown in FIG. 9C. The flexible shaft then continues the drilling operation through the cement layer 938 and steel casing 936, under the torque and translatory driving force provided by the drive motor system.

Figure 10C:
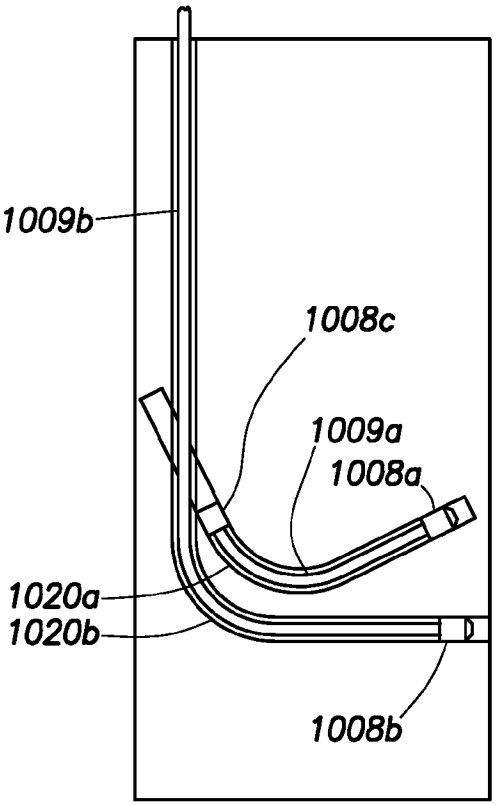
FIGS. 10A, 10B, and 10C are detailed sequential illustrations, partially in section, of a second embodiment of the dual bit configuration for perforating the walls of a cased hole.
Figure 10B:
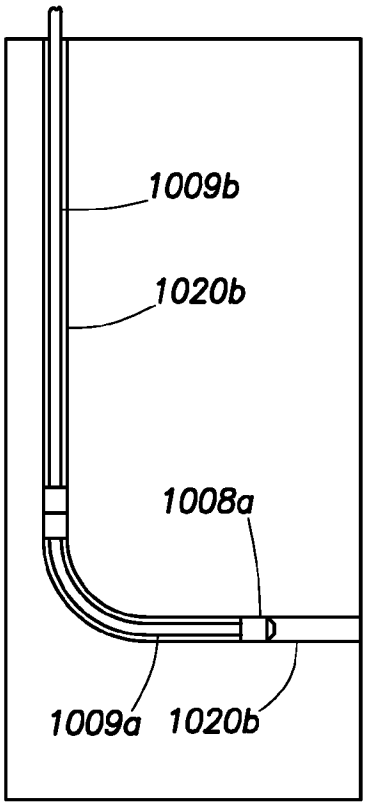
Figure 10A:
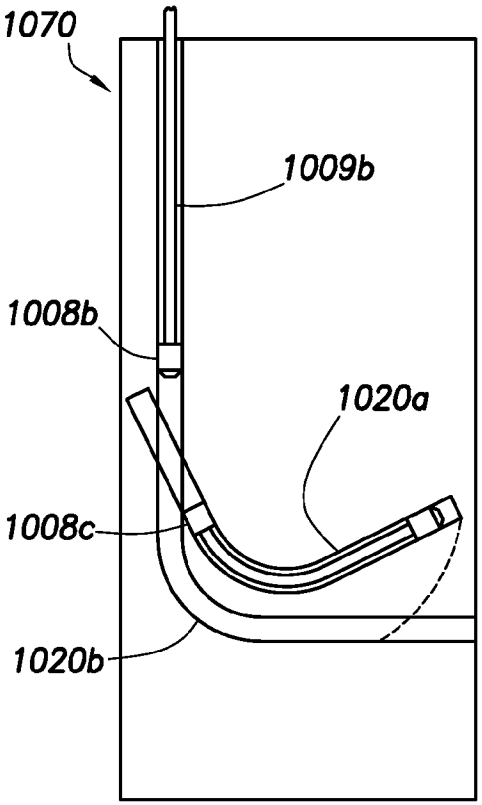

FIGS. 10A-10C show another embodiment of the dual bit perforating system 1070, FIG. 10A depicts the dual bit system in the retracted position for conveyance within a borehole. FIG. 10B depicts the system in a first drilling configuration. FIG. 10C depicts the system in a second drilling configuration. In these figures, the second drilling shaft 1009*b* has a defined drilling path defined by tubular guide 1020*b*, and the coupling assembly includes a bit coupling 1008*c* connected to an end of the first drilling shaft 1009*a* opposite the first drill bit 1008*a*. A means is provided for selectively moving the first drilling shaft 1009*a* between a holding position in tubular guide 1020*a* (see FIGS. 10A and 10C) and a drilling position in tubular guide 1020*b* (see FIG. 10B). The drilling position is located in the drilling path (i.e., tubular guide 1020*b*) of the second drilling shaft 1009*b*, thereby enabling the second drill bit 1008*b* (which is specially designed for engagement) to engage the bit coupling 1008*c* and drive the first drilling shaft 1009*a*.

Figure 11C:
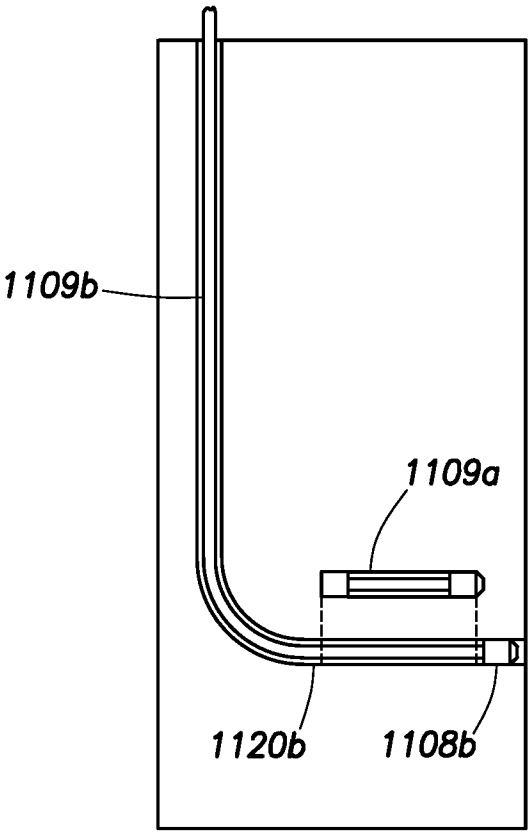
FIGS. 11A, 11B, and 11C are detailed sequential illustrations, partially in section, of a third embodiment of the dual bit configuration for perforating the walls of a cased hole.
Figure 11B:
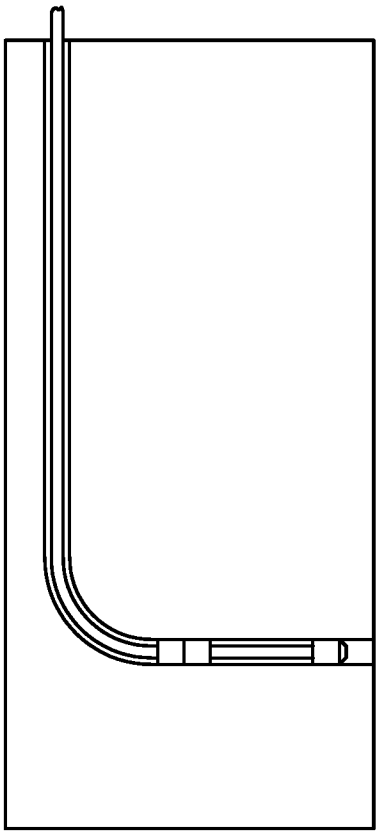
Figure 11A:
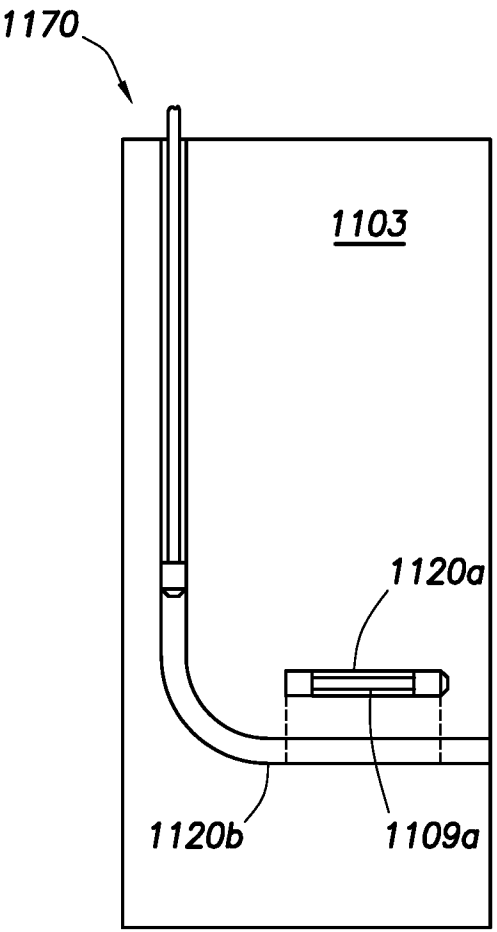

The moving means may move the first drilling shaft by a pivoting motion as shown in the dual bit perforating system 1070 of FIGS. 10A-10C or by a translatory motion as shown in the dual bit perforating system 1170 of FIGS. 11A-11C. A hydraulic piston-assist mechanism, as mentioned above, can be used here as well to provide the appropriate weight-on-bit for the casing drilling operation, and can be further used as the moving means. Thus, the hydraulic mechanism can be used to retract (by pivoting or translation) the first drilling shaft assembly 1109*a* back into the tool body 1103, and out of the way 1120*b* of the second drilling shaft 1109*b* and back to the holding position 1120*a*. Then, the second drilling shaft 1109*b* and second drill bit 1108*b* are free to translate and rotate through pathway 1120*b* so as to drill through the formation rock.

Figure 12C:
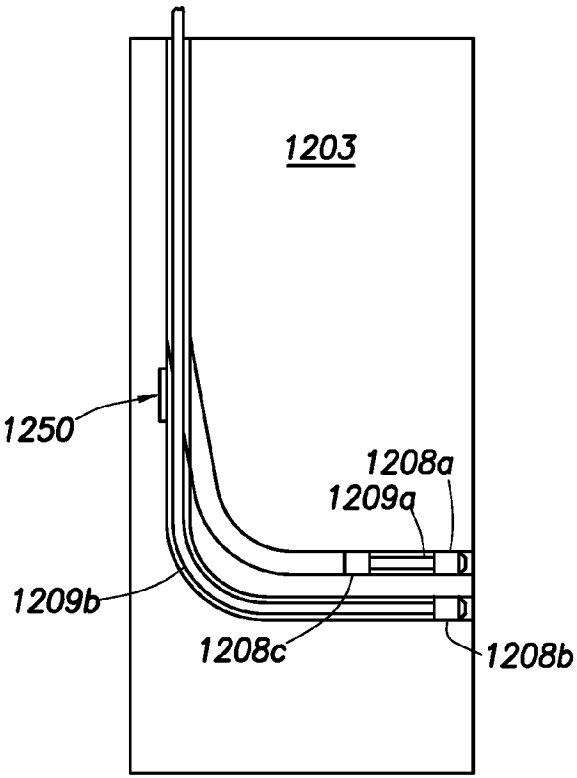
FIGS. 12A, 12B, and 12C are detailed sequential illustrations, partially in section, of a fourth embodiment of the dual bit configuration for perforating the walls of a cased hole.
Figure 12B:
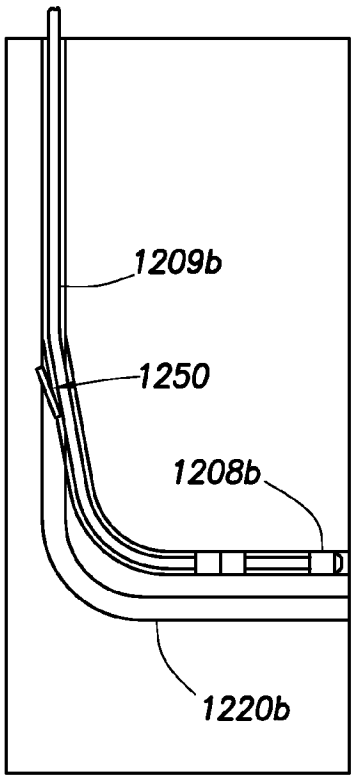
Figure 12A:
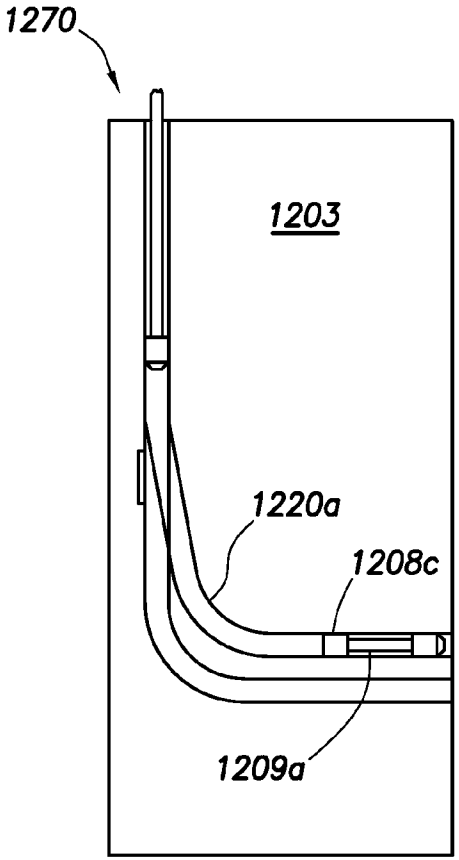

FIGS. 12A-12C depict another dual bit perforating system 1270 including tool body 1203. In these figures, the first and second drilling shafts 1209*a*, 1209*b* each have respective defined drilling paths 1220*a*, 1220*b*. Here, the coupling assembly includes a bit coupling 1208*c* connected to an end of the first drilling shaft 1209*a* opposite the first drill bit 1208*b*, and a means including a whipstock 1250 for selectively moving the second drilling shaft 1209*b* from its drilling path 1220*b* to the drilling path 1220*a* of the first drilling shaft 1209*a*. This has the effect of positioning the second drill bit 1208*b* for engagement with the bit coupling 1208*c*, whereby the second drilling shaft 1209*b* drives the first drilling shaft 1209*a*. In other words, the specially designed rock bit on the end of the flexible shaft 1209*b* interfaces with the bit coupling 1208*c* on the end of the casing bit shaft 1209*a*. Thus, a rotary motion of the casing bit 1208*a* is applied by rotation of the second (flexible) drilling shaft 1209*b*.

The casing drilling shaft 1209*a* is preferably mechanically connected to a hydraulic assist mechanism (not shown). The hydraulic assist mechanism provides the required weight-on-bit for the casing drilling operation, and retracts the casing bit assembly back into the tool body 1200 when required. When drilling the steel casing, the tool 1200 is translated downwardly (see FIG. 12B) to ensure the second drilling shaft enters the first drilling path, via the whipstock 1250, at the proper elevation. When drilling the formation rock, the tool 1200 is translated upwardly (see FIG. 12C) to ensure the second drilling shaft enters the second drilling path 1220*b* at the proper elevation, at which time the second drilling shaft 1209*b* and second drill bit 1208*b* are free to begin drilling rock via drilling path 1220*b*.

The above dual bit embodiments may require an additional mechanical operation to position the steel bit 1208*a* in the lower position (FIG. 12B) for drilling steel and for moving the first drilling shaft 1209*a* upwardly and out of the way (FIG. 12C) for drilling the formation. This mechanical operation could be accomplished by the addition of selected hydraulic components—e.g., additional solenoids and hydraulic lines to the existing systems—that are within the level of ordinary skill in the relevant art.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. An apparatus for perforating a cased borehole penetrating a subsurface formation, comprising:

a tool body adapted for conveyance within the cased borehole;

a first drilling shaft having a first drill bit connected to an end thereof for perforating a portion of the casing lining the borehole wall;

a second drilling shaft having a second drill bit connected to an end thereof for extending through the perforation in the casing and perforating a portion of the borehole wall;

a drilling motor assembly for applying torque and translatory force to the first and second drilling shafts; and a coupling assembly for selectively coupling the drilling motor assembly to one of the first drilling shaft, the second drilling shaft, and combinations thereof, wherein the coupling coupling assembly comprises a gear assembly operatively connected to both the first and second drilling shafts.

2. The apparatus of claim 1, wherein:

at least one of the drilling shafts is selectively operatively connected to the gear train.

3. The apparatus of claim 1, wherein:

the second drilling shaft has a defined drilling path; and the coupling assembly comprises:

a bit coupling connected to an end of the first drilling shaft opposite the first drill bit; and a means for selectively moving the first drilling shaft between a holding position and a drilling position, the drilling position being in the drilling path of the second drilling shaft enabling the second drill bit to engage the bit coupling and drive the first drilling shaft.

4. The apparatus of claim 3, wherein the moving means moves the first drilling shaft by a pivoting motion.

5. The apparatus of claim 3, wherein the moving means moves the first drilling shaft by a translatory motion.

6. The apparatus of claim 1, wherein:

the first and second drilling shafts have respective defined drilling paths; and the coupling assembly comprises:

a bit coupling connected to an end of the first drilling shaft opposite the first drill bit; and a means for selectively moving the second drilling shaft from its drilling path to the drilling path of the first drilling shaft enabling the second drill bit to engage the bit coupling and drive the first drilling shaft.

7. The apparatus of claim 1, further comprising an anchor system carried by the tool body for supporting the tool body within the borehole.

8. A method for perforating a cased borehole and penetrating a subsurface formation, comprising the steps of:

perforating a portion of the casing lining the borehole wall using a drilling motor assembly and a first drilling shaft having a first drill bit connected to an end thereof;

extending a second drilling shaft through the perforation in the casing using the drilling motor assembly, the second drilling shaft having a second drill bit connected to an end thereof for penetrating the formation; and perforating a portion of the borehole wall using the drilling motor assembly and the second drilling shaft with the second drill bit;

the first and second drilling shafts being selectively coupled to the drilling motor assembly to execute the perforating and extending steps.

9. An apparatus for perforating a borehole penetrating a subsurface formation, comprising:

a tool body adapted for conveyance within the borehole;

a first drilling shaft having a first drill bit;

a second drilling shaft having a second drill bit;

a mover configured to apply torque and translatory force to the first and second drilling shafts; and a coupling assembly configured to selectively couple the mover to one of the first and second drilling shafts.

10. The apparatus of claim 9, wherein the coupling assembly comprises a gear assembly operatively connected to the first and second drilling shafts.

11. The apparatus of claim 9, wherein the coupling assembly comprises means for selectively moving the first drilling shaft between a first position and a second position, the second position being in a drilling path of the second drilling shaft enabling the second drill bit to drive the first drilling shaft.

12. The apparatus of claim 11, wherein the moving means moves the first drilling shaft by at least one of a pivoting motion and a translatory motion.

13. The apparatus of claim 9, wherein:

the first and second drilling shafts have respective defined drilling paths; and the coupling assembly comprises means for selectively moving the second drilling shaft from its drilling path to the drilling path of the first drilling shaft enabling the second drill bit to drive the first drilling shaft.

14. The apparatus of claim 9, further comprising an anchor system carried by the tool body for supporting the tool body within the borehole.

15. The apparatus of claim 9, wherein:

the coupling assembly comprises a gear assembly operatively connected to the first and second drilling shafts;

the coupling assembly comprises means for selectively moving the first drilling shaft between a first position and a second position, the second position being in a drilling path of the second drilling shaft enabling the second drill bit to drive the first drilling shaft; and the moving means moves the first drilling shaft by at least one of a pivoting motion and a translatory motion.

* * * * *